US011260283B2

(12) United States Patent
Morris

(10) Patent No.: US 11,260,283 B2
(45) Date of Patent: Mar. 1, 2022

(54) ARTICLE MOVEABLE BETWEEN TWO POSITIONS AND A METHOD OF COMBINING TWO OR MORE OF THE SAME

(71) Applicant: Boti Global Limited, Kowloon (HK)

(72) Inventor: Oliver Morris, London (GB)

(73) Assignee: Boti Global Limited, Kowloon (HK)

( * ) Notice: Subject to any disclaimer, the term of this patent is extended or adjusted under 35 U.S.C. 154(b) by 0 days.

(21) Appl. No.: 16/644,682

(22) PCT Filed: Jan. 31, 2018

(86) PCT No.: PCT/GB2018/050270
§ 371 (c)(1),
(2) Date: Mar. 5, 2020

(87) PCT Pub. No.: WO2019/048814
PCT Pub. Date: Mar. 14, 2019

(65) Prior Publication Data

US 2020/0282299 A1 Sep. 10, 2020

(30) Foreign Application Priority Data

Sep. 8, 2017 (GB) ..... 1714508

(51) Int. Cl.
*A63F 9/06* (2006.01)
*A63F 9/12* (2006.01)

(52) U.S. Cl.
CPC ..... *A63F 9/0613* (2013.01); *A63F 9/0666* (2013.01); *A63F 2009/0668* (2013.01);
(Continued)

(58) Field of Classification Search
CPC ..... A63F 9/0613; A63F 9/0666; A63F 2009/0668; A63F 2009/1216;
(Continued)

(56) References Cited

U.S. PATENT DOCUMENTS 611,887 A * 10/1898 Briggs ..... A63H 13/16
446/310
877,682 A * 1/1908 Turman ..... E05B 37/025
70/28

(Continued)

FOREIGN PATENT DOCUMENTS

CA 2945923 A1 * 10/2015 ..... A63H 33/003
EP 1820548 A1 8/2007

(Continued)

*Primary Examiner* — Steven B Wong
(74) *Attorney, Agent, or Firm* — GableGotwals

(57) ABSTRACT

An article is moveable between a first position and a second position and biased to the second position. The article is retained in the first position by retaining means until a predetermined condition is met and when met, the biasing means are released to move the article from the first position to the second position. The predetermined condition is met when at least one formation of a plurality of formations located with respect to at least one face of the article is moved from a first position to a second position, thereby releasing the retaining means. The article further includes user selection means to allow the user to select which one, or combination, of the plurality of formations, when moved, will cause the release of the retaining means.

13 Claims, 11 Drawing Sheets

Figure 1A:
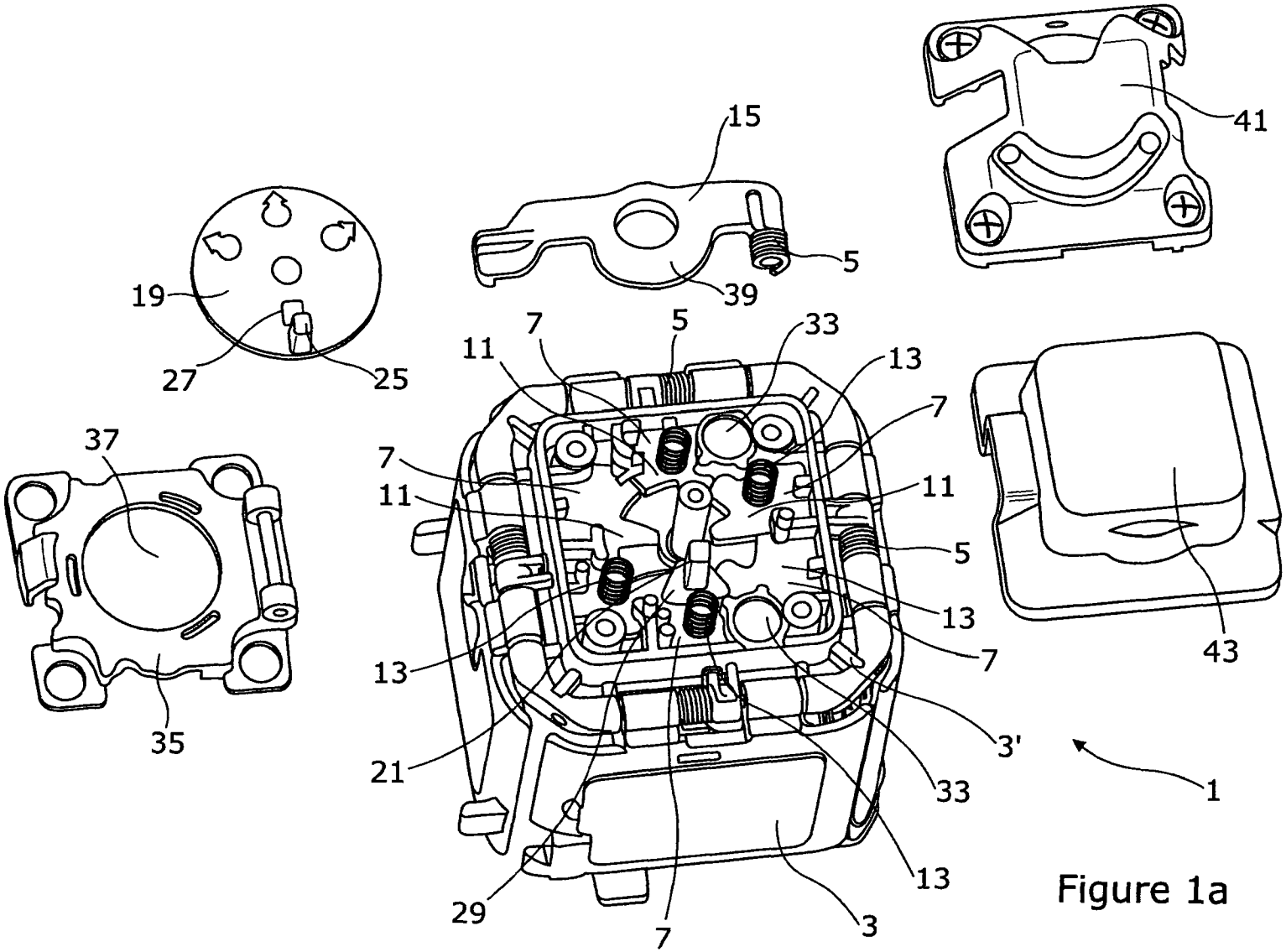

(52) U.S. Cl.
CPC . *A63F 2009/1216* (2013.01); *A63F 2250/186* (2013.01); *A63F 2250/24* (2013.01)

(58) Field of Classification Search
CPC .. A63F 2250/24; A63F 9/06; A63F 2250/186; A63H 13/16
See application file for complete search history.

(56) References Cited

U.S. PATENT DOCUMENTS 1,237,954 A * 8/1917 Provost ..... A63H 3/005
446/73
1,559,424 A * 10/1925 Hay ..... A63H 13/16
446/310
2,521,131 A * 9/1950 Sloane ..... A45C 1/12
446/9
3,037,779 A * 6/1962 Duncan ..... G11B 33/06
446/299
4,123,923 A 11/1978 Bako
4,407,504 A 10/1983 Popov
4,575,348 A * 3/1986 Wiggs ..... A63H 13/16
446/310
5,125,661 A 6/1992 Jarboe
5,564,703 A * 10/1996 McGuire ..... A63F 9/12
273/153 S
9,238,170 B1 * 1/2016 Holmes ..... A63F 9/06
10,252,175 B2 * 4/2019 Moore ..... A63H 33/26
10,639,561 B2 * 5/2020 Moore ..... A63H 33/26
2003/0176146 A1 * 9/2003 Norman ..... A63H 3/18
446/310

FOREIGN PATENT DOCUMENTS

GB 2148379 A 5/1985
WO 2015159077 A2 10/2015
WO 2017109565 A1 6/2017
WO WO-2019048814 A1 * 3/2019 ..... A63F 9/0666

* cited by examiner

ARTICLE MOVEABLE BETWEEN TWO POSITIONS AND A METHOD OF COMBINING TWO OR MORE OF THE SAME

CROSS-REFERENCE TO RELATED APPLICATIONS

This United States application is the National Phase of PCT Application No. PCT/GB2018/050270 filed 31 Jan. 2018, which claims priority to British Patent Application No. 1714508.7 filed 8 Sep. 2017, each of which is incorporated herein by reference.

The invention to which this application relates is an article or articles which are moveable between a first and second position and the movement is achieved when a predetermined condition is met. The invention further relates to a method of bringing two of said articles together in a predefined manner so as to allow the opportunity of the movement of at least one of the articles to occur.

Although the following description refers exclusively to the use of such articles as play toys and a method of playing with two or more of the same, the person skilled in the art will appreciate that the present invention could also be used for various other purposes not limited to games.

Collectable toys have been known for some time. In particular, collectable "battling" toys are also known and have been provided in many different forms, for example, the range of battling collectables sold under the trade name Beyblade™ involve propelling two spinning collectable items into a battle arena, the collectable items subsequently making contact with one another as their spinning paths coincide. The winner is the one which remains spinning in the arena having either knocked the other off of its spinning axis or out of the arena entirely. Various techniques may be used by the user when introducing the collectable item to the arena, in order to provide their collectable item with an advantage against the opposing collectable item.

Another form of collectable battling toy, sold under the trade name Bakugan™ involves toys that can transform from a first condition into a second condition prior to or during battle. Determination of the winner can be decided by a set of specific playing cards which can indicate what moves may be played or health points etc. may be gained. Again, as the battle/game progresses, users/players will have an indication of who may emerge as the eventual winner. However, neither of these sets of "battling" collectables provides a scenario where the final winner will remain unknown until the eventual outcome is known, with little or no indication prior to the outcome.

In the Applicant's co-pending international patent applications WO2015/159077 and WO2017/109565, there is disclosed an article which is provided and initially retained in a first position, but is biased to a second position. When brought into contact with or within a predetermined range of a second article, a predetermined condition is met within one of the articles, and one of the two will be "activated" to move to the second position. In the scenarios disclosed in the Applicant's co-pending application, the predetermined condition is met when a first magnet on the first article is activated by a second magnet on the second article, which, in turn, triggers a release catch, allowing the first article to move to the second position. The mechanism by which the articles are activated relies on the specific arrangement and interaction of the magnets in the interacting articles. However, over time, magnets may lose their sensitivity or attractiveness as a result of the articles being dropped, jolted etc., and consequently the functionality of the articles is reduced. In WO2017/109565, the condition is met when a formation provided on the article is moved from a first position to a second position, however, each article is provided with a set mechanism, such that only a specific formation is actuable to move the article from the first condition to the second condition.

It is therefore an aim of the present invention to provide an article that overcomes the aforementioned problems.

It is a further aim of the present invention to provide a combination of two or more articles that overcomes the aforementioned problems.

It is yet a further aim of the present invention to provide a method of combining two or more articles that overcomes the aforementioned problems.

According to a first aspect of the invention there is provided an article, said article being moveable between a first position and a second position and biased to the second position, said article being retained in the first position by retaining means until a predetermined condition is met, wherein when said predetermined condition is met the said biasing means are released to move the article from the first position to the second position, and said predetermined condition is met when at least one formation of a plurality of formations located with respect to at least one face of the article, is moved from a first position to a second position, thereby releasing said retaining means, characterized in that the article further includes user selection means to allow the user to select which one, or combination, of the plurality of formations, when moved, will cause the release of said retaining means.

In one embodiment a plurality of formations are provided on the article and all, a combination, or one, of said formations can be selected by the user via the user selection means to be that which, when moved, allows the change in condition to occur.

In one embodiment, said formations, or at least a part thereof, are arranged to extend outwardly from at least one face of the article. Typically, biasing means are provided to bias said formations outward of the article. Preferably, said formations are movable inwardly of the article.

In one embodiment, said selection means includes a selection portion, said portion being user-actuable to configure the selection means to determine which one, or combination, of the formations is to be movable to release the retaining means.

Typically, said selection portion is provided as a rotatable member. Preferably, said member is in the form of a rotatable disc or disc-shaped member. In one embodiment, said selection portion includes a user gripping portion.

In one embodiment, said selection means further includes at least one pin member. Typically, said at least one pin member is arranged to provide mechanical communication between a selected formation and said retaining means. Such communication permits "activation" of the article when the predetermined condition is met. In one embodiment, said at least one pin member is movable by a selection portion of the selection means.

In one embodiment, said selection means further includes at least one blocking member. Typically, said at least one blocking member is movable in conjunction with a pin member of the selection means and by a selection portion of the selection means.

Typically, said at least one blocking member is provided to substantially block inward movement of at least one formation. In one embodiment, said blocking member may be provided as a rotatable member having one or more blocking portions located thereon.

In one embodiment, said selection means is arranged to be movable to configure at least one formation to act as a trigger means to release said retaining means upon inward movement, and configure at least one formation not to be movable.

In one embodiment, each of said formations is provided to extend from an interior side of a face of the article, through a corresponding aperture located in said face and extending therefrom, outwardly of the article.

In one embodiment, said formations comprise an elongate portion, provided to extend through a corresponding aperture in a face of the article. Typically, said formations further comprise a base portion, located at or adjacent an interior side of a face of the article.

Thus, when a first formation is selected by the selection means, the pin member contacts or moves over the base portion of the formation, and subsequent inward movement of the formation engages the pin member, consequently triggering and/or releasing said retaining means.

In one embodiment, upon selection of a first formation by said selection means to be movable to release said retaining means, a second formation is simultaneously selected, and said blocking member is arranged to engage said second formation, preventing inward movement of that formation with respect to the article. Typically, any remaining, unselected formations may be movable but are not arranged to engage/activate/trigger said retaining means.

The provision of selection means with the article in accordance with the present invention therefore allows a user to configure the article and alter which formations provided thereon may activate the retaining means, and also which may have their movement blocked, such that they act as a substantially solid pin extending from a face of the article. Unselected formations in a given configuration are, consequently, movable inwardly of the article but would have no impact on the mechanism by which the retaining means may be released, subsequently enabling the article to move from the first to the second position. Thus, in any given configuration, only one formation is movable to engage and release the retaining means, resulting in the predetermined condition being met. This is a distinct improvement over what currently exists in the prior art as a single article may be configured however a user chooses. This is opposed to either having to have a different article for each configuration, or having a number of differing removable body portions, which may then be inserted into the article, having a particular configuration.

In one embodiment, at least three formations are provided. Typically, therefore, at least one formation is selectable to release said retaining means upon movement, at least one formation is selectable to be blocked from movement, and at least one formation remains unselected by said selection means.

In another embodiment, six formations may be provided. Typically, said selection means is movable between three configurations. Further typically, any one of three formations may be selectable to be movable to release said retaining means, and any one of the remaining three formations may be selectable to be blocked from movement by said blocking member.

In one embodiment, where six formations are provided, each of the three formations selectable to be movable to release said retaining means may be paired with a corresponding formation of the remaining three formations, selectable to be blocked from movement by said blocking member.

In one embodiment, said formations are provided to interact with a plurality of formations provided on second and further articles.

In one embodiment, the said predetermined condition is created by a second article which may in one embodiment, be similar to the first article, being brought into contact with, or being positioned within a predetermined range of, the said first article.

In one embodiment, the plurality of formations and said retaining means are associated substantially with one face of the article. Typically, the formations and said retaining means are associated substantially with the same face of the article. Further typically, said retaining means connects the face with which it is associated to an adjacent face, thereby retaining the article in the first position.

In one embodiment, the retaining means are provided in the form of a catch. Typically, said catch is releasable when a selected formation is urged inwardly of the article by a predetermined distance.

In one embodiment, faces of the article are hinged. Typically, said retaining means retains adjacent free edges of two faces, thereby retaining the article in the first position. Further typically, the article is retained in the first position by the retaining means against the action of the biasing force.

In one embodiment, said second position is an inverted form of the article with respect to said first position. Typically, when said predetermined condition is met, the article moves from said first position to the second, inverted position.

Preferably, said selection means is located in an interior of the article, when the article is in the first position.

In one embodiment, the article forms a polyhedron composed of four or more faces and/or panels. Typically, the article forms a tetrahedron, pentahedron, cube, octahedron, dodecahedron, or icosahedron shape and/or the like. Further typically, the faces and/or panels of the polyhedron are biased to the second position.

In one embodiment, the article may be composed of six faces. Typically, said six faces connect to form faces of a substantially cube-shaped article. Further typically, said faces are biased to the second position.

In one embodiment, said biasing means are provided in the form of one or more springs. Typically, said one or more springs are provided as any or any combination of coil springs, leaf springs, torsion springs, hair springs and/or the like.

In one embodiment, biasing means are provided at or substantially at an interface between two adjacent faces of the article. Typically, said biasing means are connected to the two adjacent faces, biasing said faces to the second position.

In one embodiment, at least one magnet is provided associated with the article. Typically, said at least one magnet is located on a face of the article. Preferably, said at least one magnet is located on the same face of the article with which the plurality of formations is associated. In one embodiment, two magnets are provided, located on the said face of the article.

In one embodiment, said at least one magnet is provided to align the article substantially with a second article. Preferably, two magnets are provided on substantially opposing sides of the same face of the article, so as to align the article with corresponding magnets located on a second article. Thus, magnets are provided on the article which serves purely as a directional force for the article when aligning the same with a second article with which it may interact. This permits interaction of the active faces of the respective articles, allowing the predetermined condition to be met for one of the articles when they are brought into contact or within a predetermined proximity of one another. When the predetermined condition is subsequently met for one of the articles, the retaining means of that article is released and the article is permitted to move from the first position to the second position.

In one embodiment, the article further includes reset means. Typically, said reset means are provided to aid a user in moving the article from the second position to the first position. Thus, the reset means are provided so as to aid a user in moving the article back from an inverted position to which it has been biased upon release of the retaining means, back to the original first position.

In one embodiment, the selection means further includes cover means, provided thereon. Typically, said cover means is provided to protect the mechanism of the selection means when the article is moved to the second position, and the selection means id therefore located on an exterior face of the article. Further typically, said cover means is removable, thereby permitting a user to access said selection means and configure the article as desired.

In one embodiment, a further article may be provided. Typically, said further article includes at least one face comprising a plurality of recesses and formations. Further typically, said formations are provided as substantially rigid formations.

In one embodiment, said further article includes the same number of recesses and formations as there are present on said first article.

Preferably, the further article includes a plurality of formations, said formations being arranged to activate the first article regardless of the configuration in which it is placed. Typically, said further article is arranged to ensure the predetermined condition for the first article is met, regardless of the configuration in which it is placed, thereby moving the first article from the first position to the second position.

In one embodiment, at least one magnet is provided associated with the further article. Typically, said at least one magnet is located on a face of the further article. Preferably, said at least one magnet is located on the same face of the further article with which the plurality of formations is associated. In one embodiment, two magnets are provided, located on the said face of the further article.

In a further aspect of the present invention, there is provided a group of articles including at least two articles movable between first and second positions and biased to the second positions, said articles retained in their respective first positions by retaining means until a predetermined condition is met, wherein said predetermined condition is met for at least one of the articles when the articles are brought into contact or within a predefined distance, at which point said one of the at least two articles moves from the first position to the second position under the influence of biasing means, and said predetermined condition is met when at least one of a plurality of formations, located on, or extending through at least one face of said one of the at least two articles, is moved from a first position to a second position, thereby releasing said retaining means and permitting movement of the said article from the first position to the second position, characterized in that the articles further include selection means arranged to permit user selection to predetermine which one of the plurality of formations is movable to release said retaining means.

Typically, said at least one formation is provided to be urged substantially inwardly of that article, to its second position, thereby releasing said retaining means.

Typically, said at least one formation on the first article is arranged to be urged substantially inwardly upon contact with a corresponding formation on the second of the at least two articles. Preferably, the corresponding formation, located on the said second article, is provided to be blocked from moving from a first position to a second position, such that it cannot be urged inwardly of the article on which it is located, but is arranged to urge the first formation on the first article inwardly, such that the predetermined condition is met for the first article.

In one embodiment, each of the first and second articles includes at least one formation which may be urged inwardly of the article from a first position to a second position to release associated retaining means, and at least one formation provided to be blocked from movement, such that it cannot be urged inwardly of the article. Preferably, each article includes a plurality of formations which may be moved from first to second positions, typically, by being urged inwardly of their respective article. Typically, only one of the formations, when urged inwardly of the article, releases the retaining means.

Preferably, said selection means is arranged to select, as chosen by a user, which of said formations may release said retaining means and which is to be blocked from movement.

In one embodiment, said second position is an inverted form of the at least two articles with respect to said first position. Typically, when said predetermined condition is met in one of the articles, the article moves from said first position to the second, inverted position.

In one embodiment, said second position, when the predetermined condition is met in a first of the at least two articles, is for the first article to move, typically inverting, and at least partially engulfing, enclosing and/or entrapping a second of said at least two articles.

In one embodiment, selection means on each of said articles are actuable to select a first formation, on each article, to be movable to release said retaining means, and simultaneously select a second formation, on each article, arranging a blocking member to engage the said second formations, preventing inward movement of those formations with respect to the articles. Typically, any remaining, unselected formations may be movable but are not arranged to engage/activate/trigger/release said retaining means.

In one embodiment, a first formation on or associated with, a first article, selected to be movable to release said retaining means, corresponds to a second formation, arranged to be blocked from movement, on or associated with, a second article. Further typically, when the first formation on or associated with, the first article contacts the second formation on or associated with, the second article, the first formation is urged inwardly of the first article and the predetermined condition is met for the first article. Thus, the first article is now moveable from the first position to the second position. Yet further typically, the movement of the first article from the first position to the second position involves the first article at least partially engulfing, enclosing and/or entrapping the second article.

In one embodiment, the first formation on or associated with, the second article, selected to be movable to release said retaining means, corresponds to a second formation, arranged to be blocked from movement, on or associated with, a third article. Typically, the second formation, arranged to be blocked from movement, on or associated with the first article corresponds to a first formation on or associated with the third article, selected to be movable to release said retaining means.

In one embodiment, a further article may be provided, in addition to the first, second and, where present, third articles. Typically, said further article includes at least one face comprising a plurality of recesses and formations. Further typically, said formations are provided as substantially rigid formations.

In one embodiment, said further article includes the same number of recesses and formations as there are present on said group of articles.

Preferably, the further article includes a plurality of formations, said formations being arranged to activate any or all of the first, second and, where present, third articles regardless of the configuration in which they are placed. Typically, said further article is arranged to ensure the predetermined condition for the first, second and, where present, third articles is met, regardless of the configuration in which they are placed, thereby moving the particular article from the first position to the second position.

In another aspect of the present invention, there is provided a method of causing interaction between at least two articles, said method comprising the steps of: providing at least two articles in respective first positions and moveable between said first position and respective second positions; moving the at least two articles towards each other until a predetermined condition for either or both of the first and/or second articles is met and wherein once said predetermined condition is met in an article, biasing means exert a biasing force to move that article from the first position to the second position, and said predetermined condition is met when at least one of a plurality of formations, located on at least one face of that article, is moved from a first position to a second position, by a corresponding formation on the other article, thereby releasing said retaining means and permitting movement of that article from the first position to the second position, characterized in that the articles further include selection means arranged to permit user selection to predetermine which one of the plurality of formations is movable to release said retaining means.

Preferably, prior to the interaction between the two articles, a user of each article configures the respective selection means to select which one of the plurality of formations is movable to release said retaining means.

In one embodiment, said selection means of each article may be configured by respective users to select a first formation to be movable to release said retaining means of that article, and simultaneously select a second formation to be blocked from movement by a blocking member of the selection means, of that article. Typically, remaining, unselected formations will be movable within their respective articles, but have no impact on the activation/release/triggering etc. of the retaining means.

Thus, as the articles are moved to interact with one another, each formation on the first article will interact with a corresponding formation on the second article. When unselected formations meet with either other unselected formations, a formation blocked from movement, or a formation movable to release retaining means, the predetermined condition is not met and retaining means are not released. However, when a formation blocked from movement on, for example, the second article, interacts with a formation movable to release retaining means on, for example, the first article, the predetermined condition is met for the first article, and so the retaining means are released and the first article moves from the first position to the second position, typically inverting, and at least partially engulfing, enclosing and/or entrapping the second of the at least two articles.

In one embodiment, a third article is provided for interaction with the first and second articles.

In one embodiment, the selection means of each of said first, second and third articles may be movable between three configurations, one of which may be selected by a user. Thus, the articles may be provided with a selection means that provides a "rock, paper, scissors" style of configurations for a user to choose and subsequently move a first article to interact with a second of further articles. Typically, the "winner" may be deemed to be the article for which the predetermined condition has been met, and has moved from the first position to the second position.

Figure 2B:
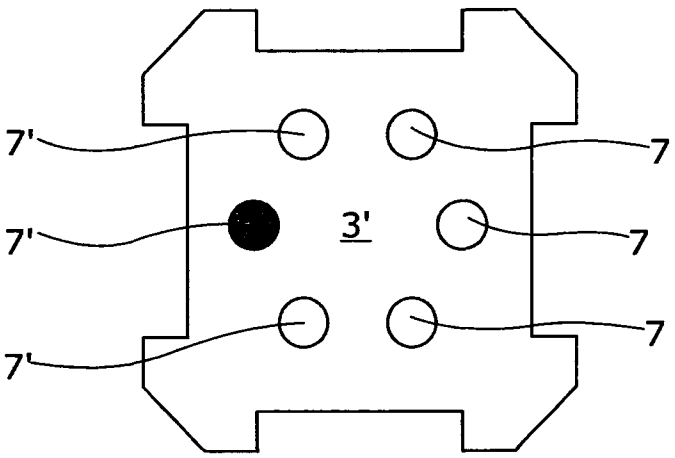
Figure 2A:
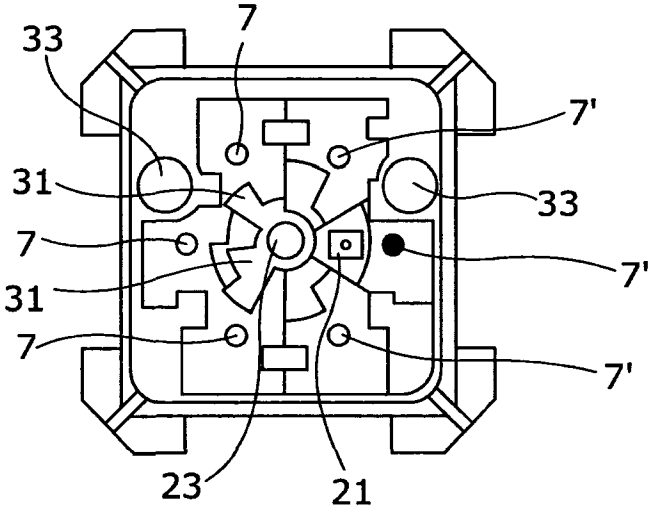
Figure 3:
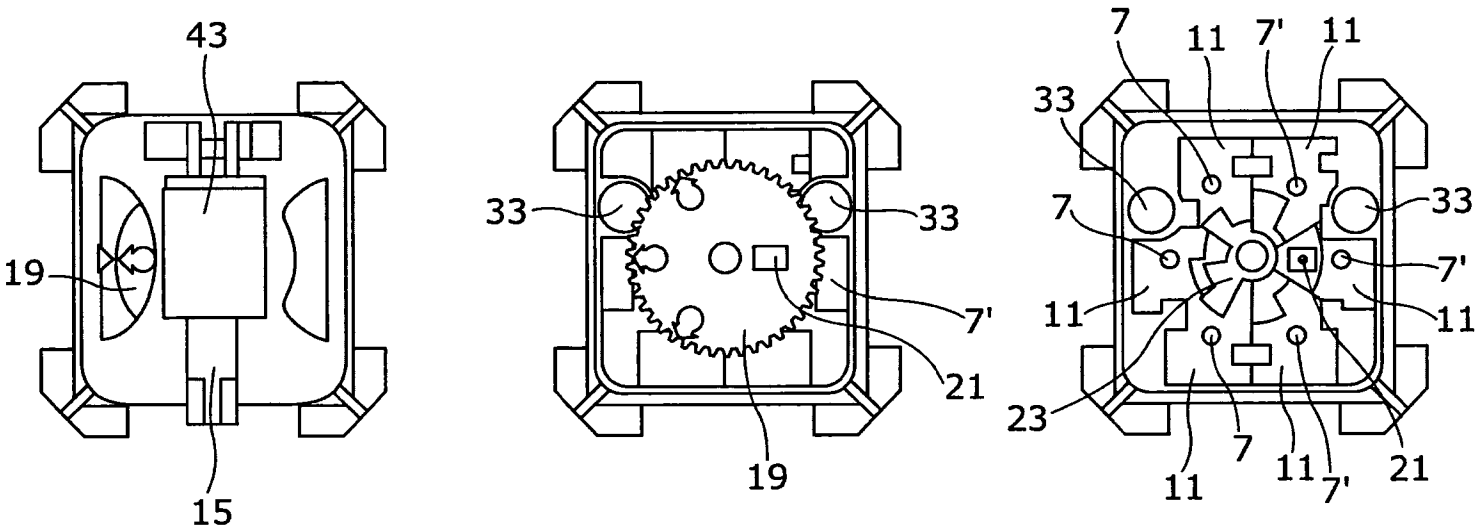
Figure 4:
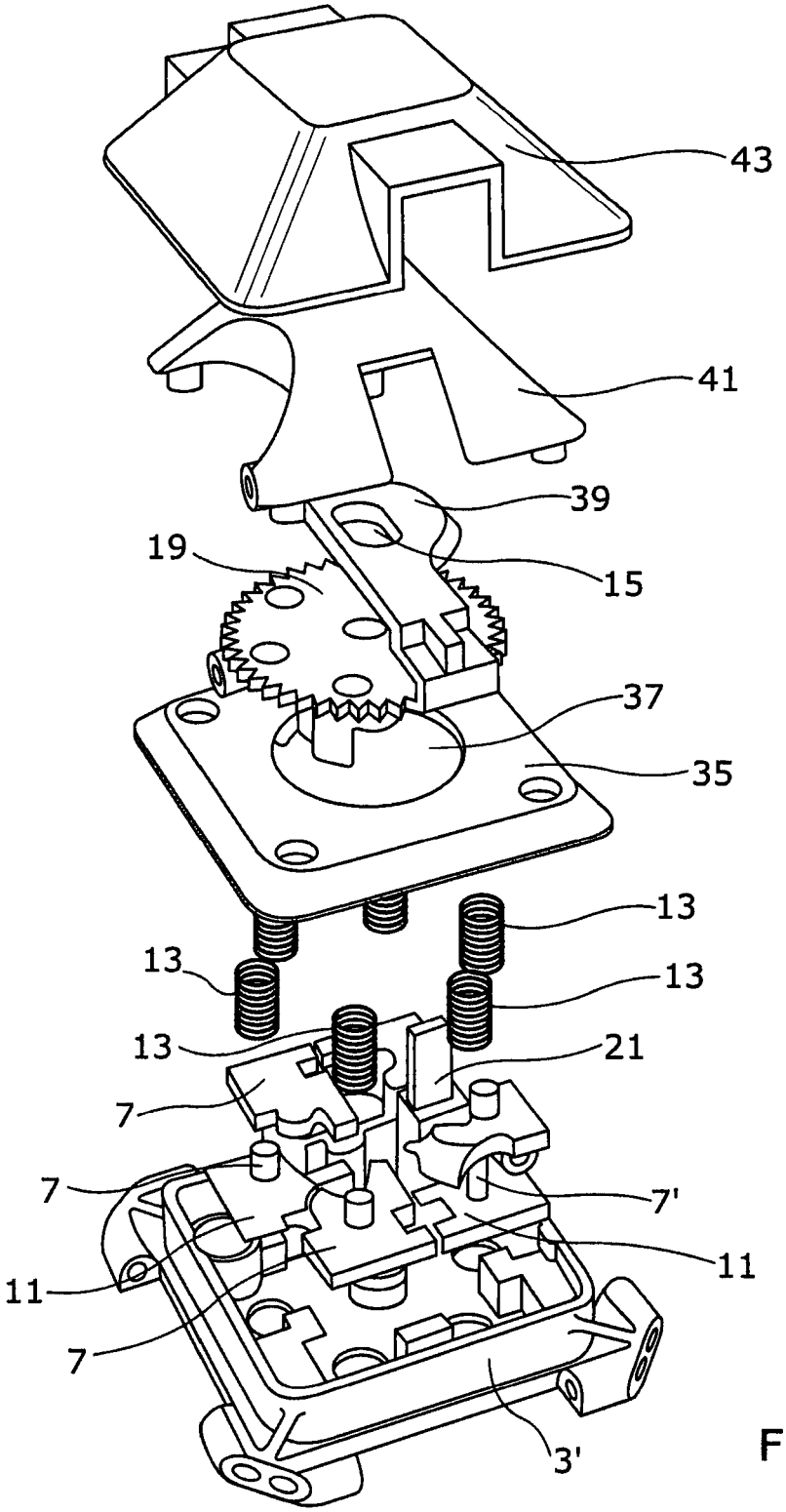

Embodiments of the present invention will now be described with reference to the accompanying figures, wherein:

FIGS. 1*a-f* illustrate the component parts of a selection means, in various exploded stages, of an article in a second position, in accordance with an embodiment of the present invention;

FIGS. 2*a-b* illustrate interior and front views of a face of an article with which selection means is associated, in accordance with an embodiment of the present invention;

FIG. 3 illustrates various views of an interior face of an article, in accordance with an embodiment of the present invention; and FIG. 4 illustrates an exploded perspective view of a selection means on a face of an article, in accordance with an embodiment of the present invention.

Figure 5A:
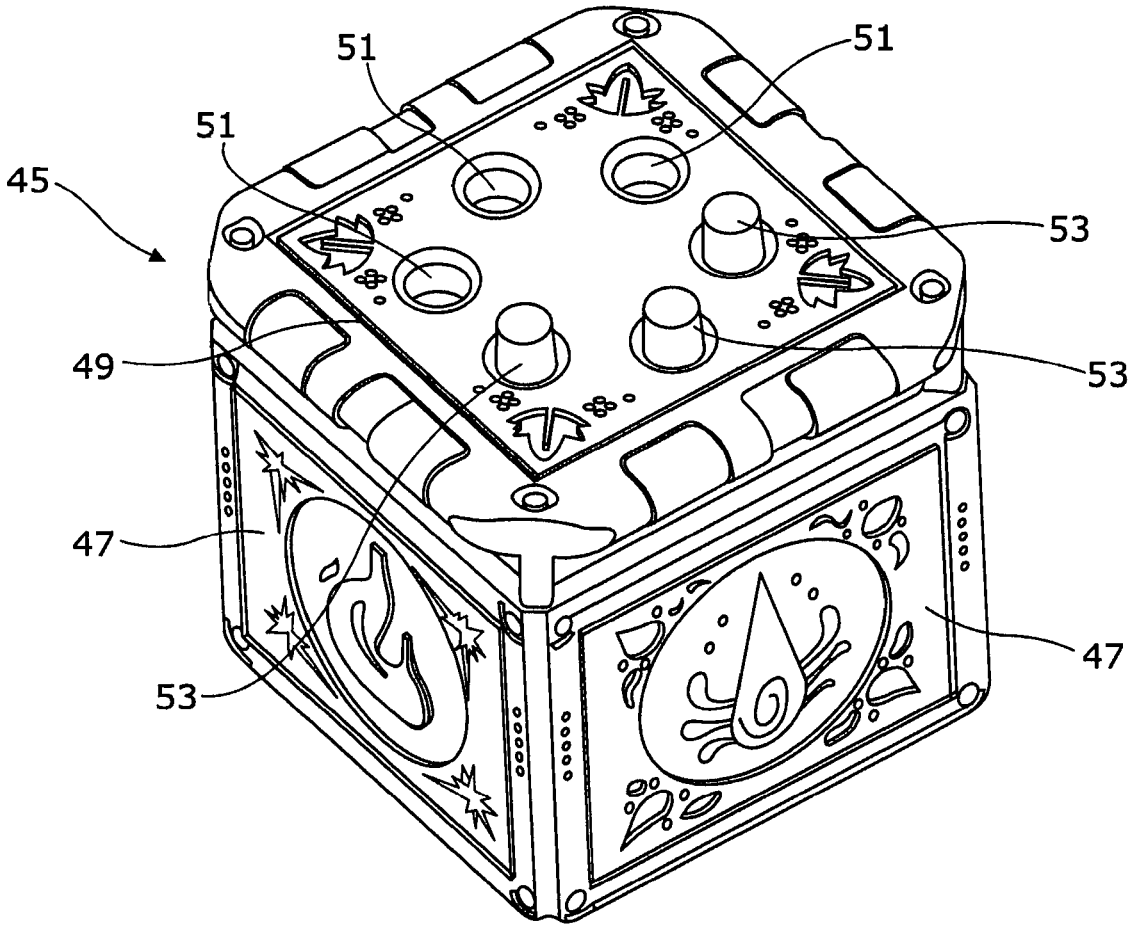
Figure 5B:
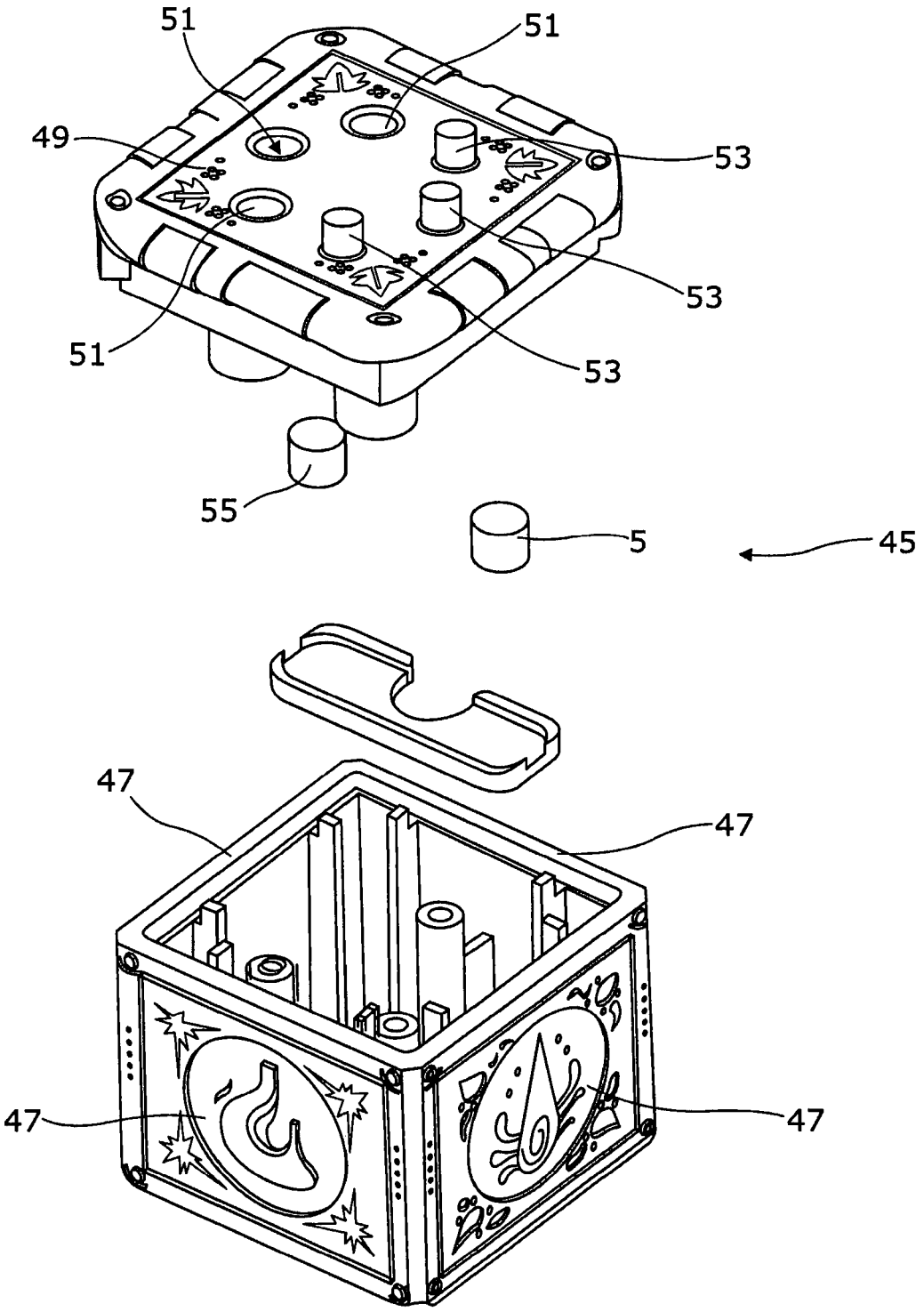

FIGS. 5*a* and 5*b* illustrate views of an alternate embodiment of the present invention.

Referring now to FIGS. 1*a-f*, there is shown an article in the form of a substantially cube-shaped playing collectable item or toy 1. The toy 1 can be moved from a first position, to a second position, wherein the toy 1 is completely inverted with respect to its first position. The second, inverted position is illustrated in FIGS. 1*a-f* for the purposes of describing the components associated therewith in accordance with the invention. In the Applicant's co-pending international patent applications WO2015/159077 and WO2017/109565, there is disclosed an article which is provided and initially retained in a first position, but is biased to a second position as show in the present invention, and a similar layout and movement from the first to the second positions as described in those applications is utilised in the present application. The toy 1 is provided in a substantially cube shape and is composed of six connected panels 3. The panels 3 are biased, via biasing means in the form of a number of springs 5, to move to the second position, but are retained in the first position until a predetermined condition is met. When the predetermined condition is met, the toy 1 moves from the first position to the second position.

A number of formations 7 are provided associated with a particular face or panel 3' of the toy 1, which extend from an interior side of the article, through corresponding holes in the panel 3' and extending outwardly therefrom. The front view of the panel 3' with the formations protruding outwardly is best shown in FIG. 2*b*; FIG. 2 a shows the interior side. The formations 7 comprise and elongate portion 9, which extends from the interior side of the panel 3', through the apertures and to the exterior; and a base or plate portion 11, which rests at or adjacent the interior side of the panel 3'. The formations 7 are movable from a first position, whereby they extend outwardly from the exterior of the panel 3', and a second position, wherein all or part of the formations 7, may be urged inwardly of the panel 3' of the toy 1. The formations 7 are biased to the first position by the provision of coiled spring members 13, best shown in FIG. 1*a* and FIG. 4. The present embodiments illustrate six formations 7 being provided, however, it will be appreciated that the present invention may function with as few as two formations 7, though preferably at least three; the upper limit being set by whatever the manufacturer deems to be desired and/or practicable.

Retaining means in the form of a release catch 15 is located on the panel 3' with the formations 7, and, when the toy 1 is in the first position, the catch 15 engages an adjacent panel 3, retaining it and the remaining panels 3 in the first position. The panels 3, 3' of the toy 1 are hinged and the release catch 15 retains adjacent edges of two panels 3, 3' in position, thereby retaining the toy 1 in the first position. The toy 1 is retained in the first position by the release catch 5 against the action of a biasing force created by the coiled torsion springs 5 until such point that it is released. The springs 5 are located at the edge of a panel 3, connecting the panel 3 on which it is located with an adjacent panel 3. The series of springs 5 that are provided on the panels 3 bias the toy 1 to the second, inverted position. This biasing movement is only allowed, however, upon release of the catch 15 from the adjacent panel 3 to which it connects. When the catch 15 is released from the adjacent panel 3, that panel 3 opens outwardly due to the biasing force of the springs 5, and the toy 1 moves to the second position as illustrated in FIGS. 1*a-f*.

The predetermined condition is met when one of the formations 7 is urged inwardly of the toy 1 from its first, resting position to the second position, such that it engages the catch 15 and subsequently releases it from a catch/retaining position. Upon release, the toy 1 moves from the first position to the second position, as described above. The toy 1 is provided with a selection mechanism 17, which permits a user of the toy 1 to select which formation 7, when urged inwardly of the toy 1 engages the catch 15 and subsequently releases it, allowing the toy 1 to move from the first position to the second, inverted position. The selection mechanism 17 includes various components, in particular, a selection portion in the form of a rotatable disc 19, a pin member 21 which locates over part of the base or plate portion 11 of a selected formation 7, and is movable by the rotatable disc 19, and a blocking member 23, which is provided to prevent movement of at least one of the formations 7. The rotatable disc 19 is provided to be user actuable, allowing a user to move and rotate the same, as required, so as to determine which one of the formations 7 is to be movable to release the catch 15. In some examples, the disc 19 may include a protruding gripping portion 25, making it easier for the user to configure the disc 19, and hence the selection mechanism 17, as desired. The pin member 21 of the mechanism 17 is arranged to provide mechanical communication between a selected formation 7 and the catch 15. The pin 21 is movable by the disc 19 via the provision of an aperture 27 located in the disc 19 sized to permit the pin 21 to extend therethrough. Thus, as the pin 21 moves over a selected formation 7, and that formation 7 is urged, from an exterior side of the toy 1, inwardly, the plate 11 of the formation 7 engages the pin 21, or a base 29 thereof, subsequently moving the pin 21 to extend further through the aperture 27 in the disc 19 and into engagement with the catch 15. Upon engagement, the catch 15 is released and the toy 1 moves from the first position to the second, inverted position.

The selection mechanism further includes a blocking member 23, as mentioned above. The blocking member 23 forms part of the selection mechanism 17 and is movable concurrently with the pin 21. As the pin 21 is moved to a position to select a particular formation 7 to act as a "trigger" for ensuring the predetermined condition is met and the toy 1 is "activated", the blocking member 23 is simultaneously moved, again by movement of the disc 19, over at least a part of the plate 11 of another formation 7. The blocking member 23 is so connected to the pin member 21 such that movement of the pin 21 by the disc 19 causes movement of the blocking member 23; the parts forming the selection mechanism 17 as a whole. Thus, the blocking member 23 is arranged to rotate about a central axis on the panel 3 as the disc 19 is rotated, and a pattern of blocking portions 31 is provided, which move over parts of the plate portions 11 of the formations 7 as the blocking member 23 is rotated. The face of the blocking member 23 or portion 31 which engages the plate 11 consequently prevents any inward movement of that formation 7. In other embodiments of the present invention, the blocking member 23 may be provided as a series of blocking details extending from an underside of the disc 19, which engage with various portions of the plates 11 of the formations 7. Such an embodiment may be advantageous this reduces the number of moving parts within the mechanism and, thus, fewer points where malfunction may occur. The remaining formations 7 which are left unselected—there are four in the illustrated embodiments but there could be as few as one—are left movable, but have no impact on the activation of the catch 15 and, thus, the movement of the toy 1 from the first position to the second, inverted position.

The provision of a selection mechanism 17 with the toy 1 in accordance with the present invention therefore allows a user to configure the toy 1 and alter which formations 7 provided thereon may activate the catch 15, and which may also have their movement blocked, such that they act as a substantially solid pin extending from a face or panel 3 of the toy 1. Unselected formations 7 in a given configuration are, consequently, movable inwardly of the toy 1 but would have no impact on the mechanism by which the catch 15 may be released, subsequently enabling the toy 1 to move from the first to the second, inverted position. Thus, in any given configuration, only one formation 7 is movable to engage and release the catch 15, resulting in the predetermined condition being met. This is a distinct improvement over what currently exists in the prior art as a single toy 1 may be configured however a user chooses. This is opposed to either having to have a different toy for each configuration, or having a number of differing removable body portions, which may then be inserted into the toy, having a particular configuration.

In the illustrated embodiments, six formations 7 are provided on the toy 1. The formations 7 are arranged, however, such that only one of three formations 7' may be selectable to be movable to release the catch 15, and each selected formation 7' is paired with a corresponding formation 7 of the remaining three formations 7, which is selectable to be blocked from movement by said blocking member 23. The formations 7' of the toy 1 which are movable to release the catch 15 are therefore provided to interact with corresponding formations 7 on a second article or toy 1', which can be configured to be blocked from movement, provided with a similar make-up. The formations 7 of the first toy 1 which can be configured to be blocked from movement are provided to interact with formations 7' on the second toy 1' which are movable to release the catch 15' on the second toy 1'. The predetermined condition for the first toy 1 may then be met when the second toy 1' is brought into contact with, or positioned within a predetermined range of, the first toy 1. Given that any one of three configurations may be selected for each toy, the interaction between the two toys effectively acts as a "rock, paper, scissors" interaction. Thus, as the toys are moved to interact with one another, each formation 7, 7' on the first toy 1 will interact with a corresponding formation 7', 7 on the second toy 1'. When unselected formations meet with either other unselected formations, a formation blocked from movement, or a formation movable to release the respective catch 15, the predetermined condition is not met and the catch 15 is not released. However, when a formation blocked from movement on, for example, the second toy 1', interacts with a formation movable to release the catch 15 on, for example, the first toy 1, the predetermined condition is met for the first toy 1, and so the catch 15 is released and the first toy 1 moves from the first position to the second, inverted position, and at least partially engulfing, enclosing and/or entrapping the second toy 1'. A third and/or further toys 1" may also be provided, and a configuration chosen by a user using the selection mechanism 17, prior to interaction with any of the other toys present.

The toy 1 is also provided with one or more magnets 33 attached thereto. In the described embodiments, two magnets 33 are provided integral with the panel 3' of the toy 1 at opposing sides thereof. The magnets 33 are provided so as to align the toy 1 with a second or further toys 1' prior to contact between the two. The magnets 33, therefore, are provided in the present invention purely as a directional force for the toy 1 when aligning the same with a second toy 1' with which it may interact. This permits interaction of the active panels 3' of the respective toys, allowing the predetermined condition to be met for one of them when they are brought into contact with one another. The toy 1 may also include a reset mechanism (not shown). Typically, the reset mechanism is provided to aid a user in moving the toy 1 from the second position back to the first position. Thus, the reset mechanism provided so as to aid a user in moving the article back from an inverted position to which it has been biased upon release of the catch 15, back to the original first position.

Figure 1B:
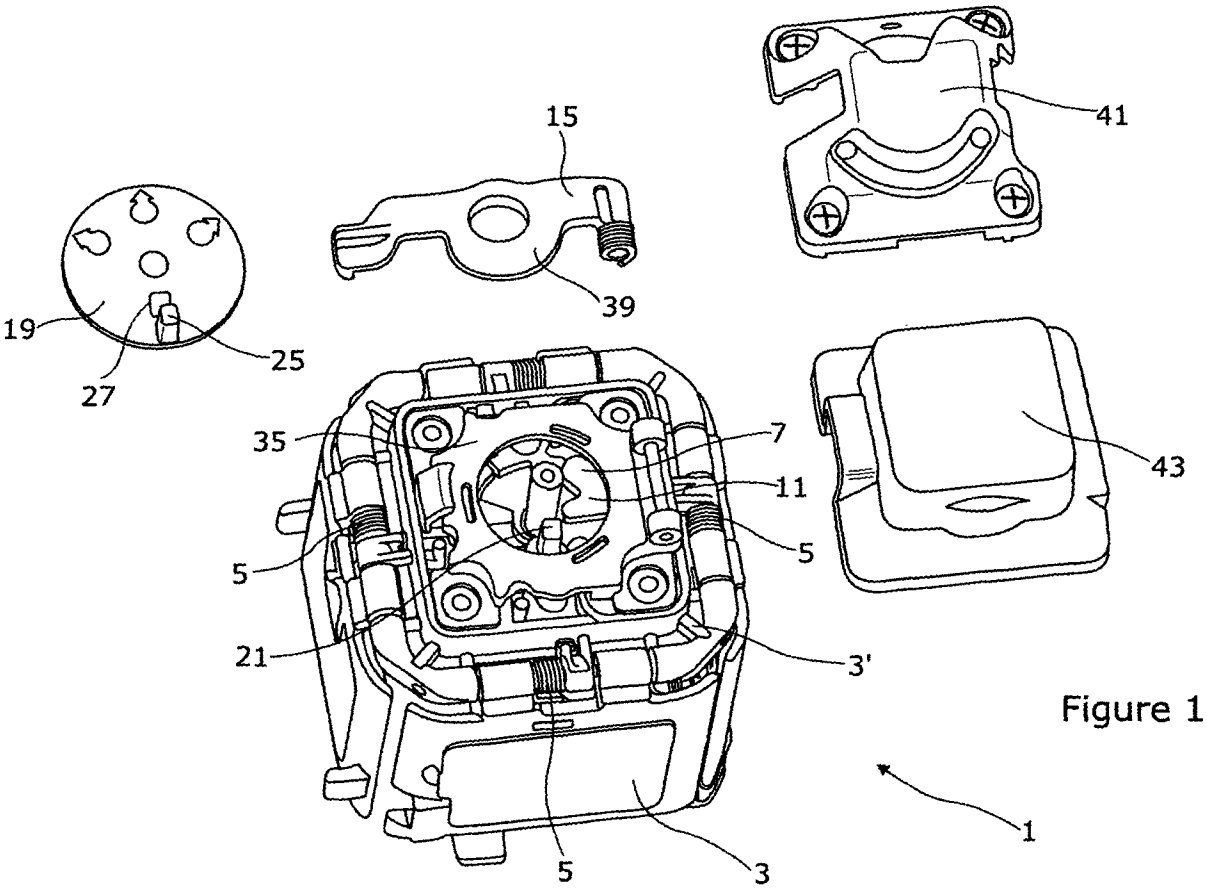
Figure 1C:
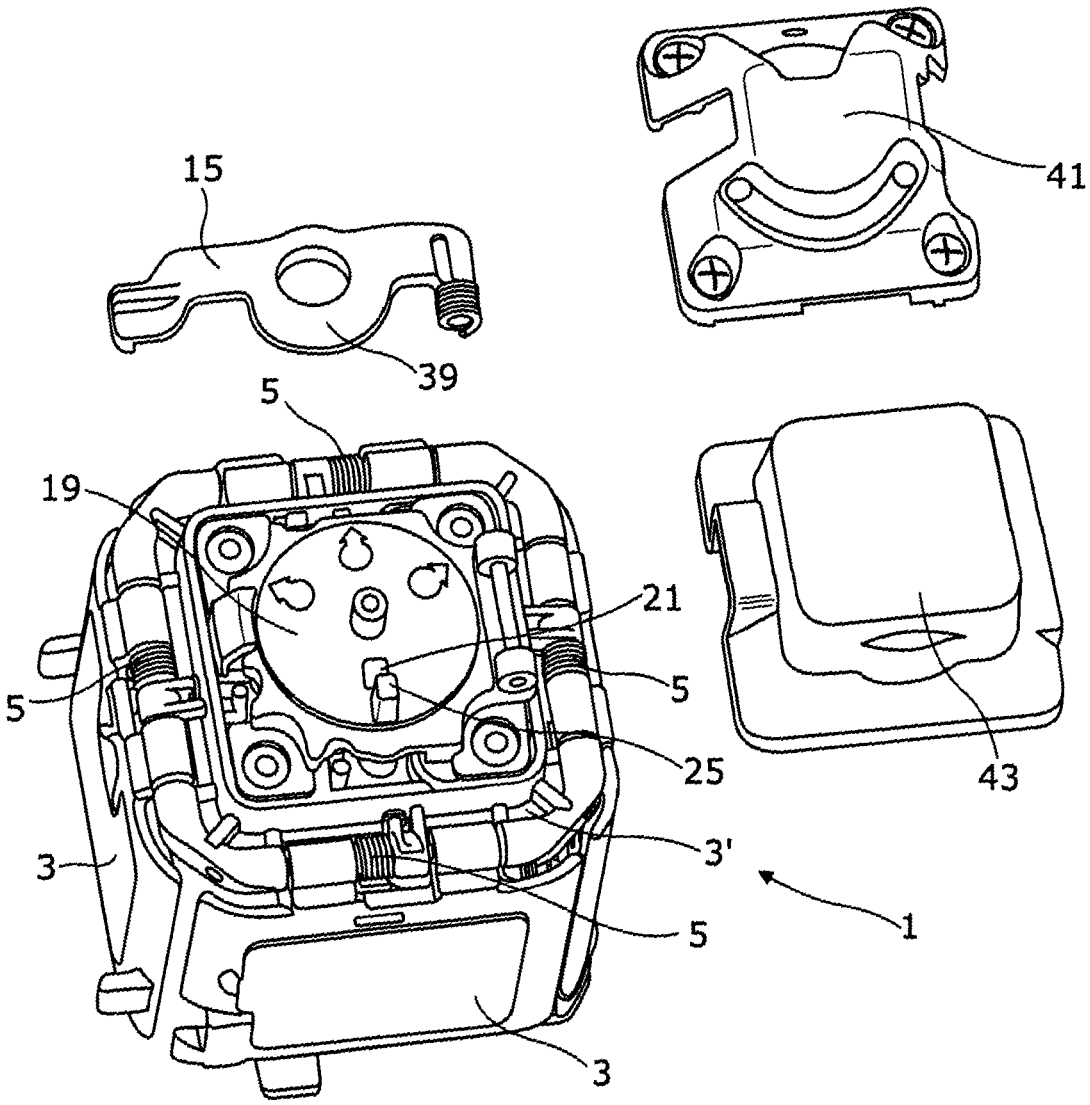
Figure 1D:
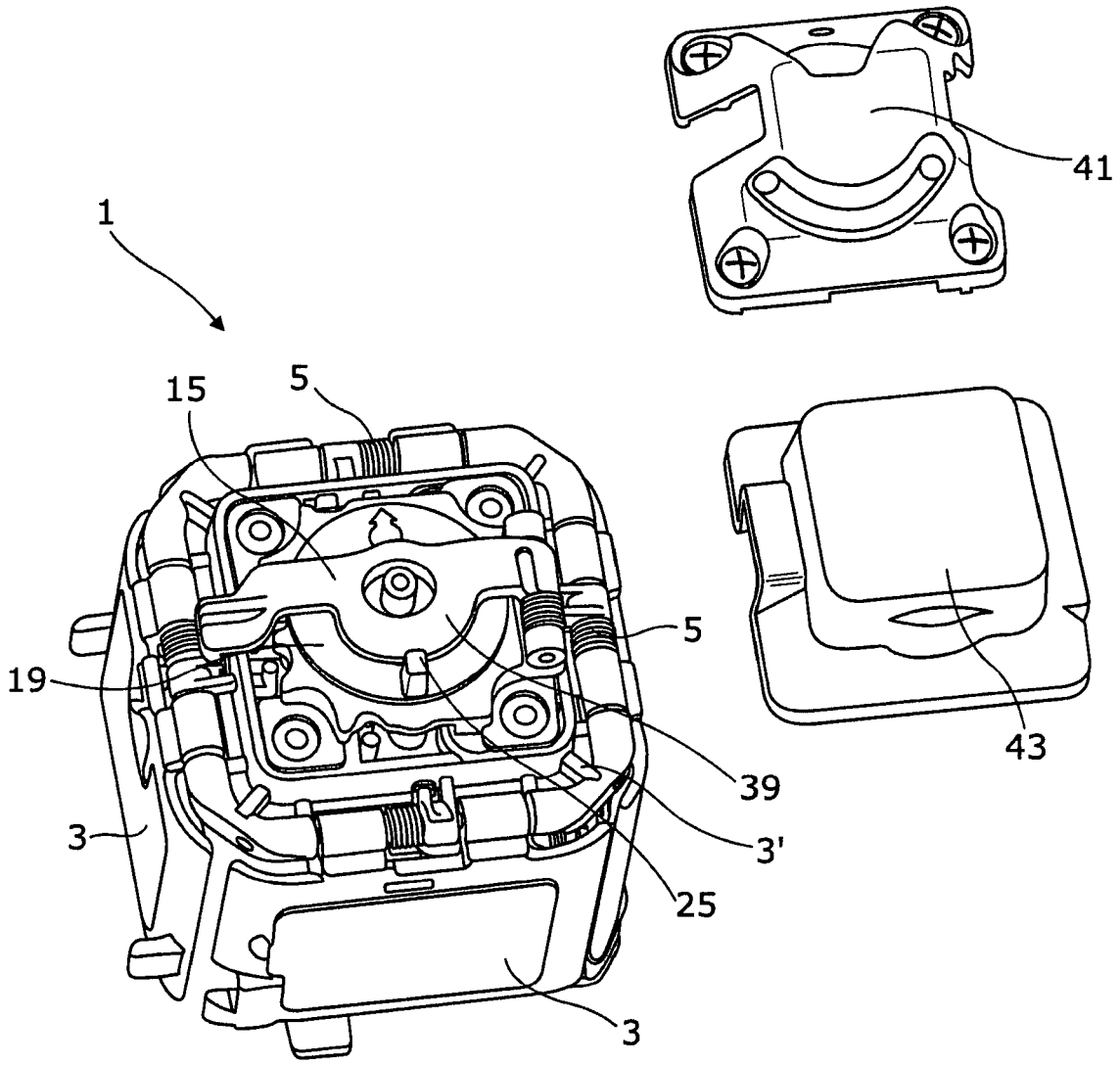
Figure 1E:
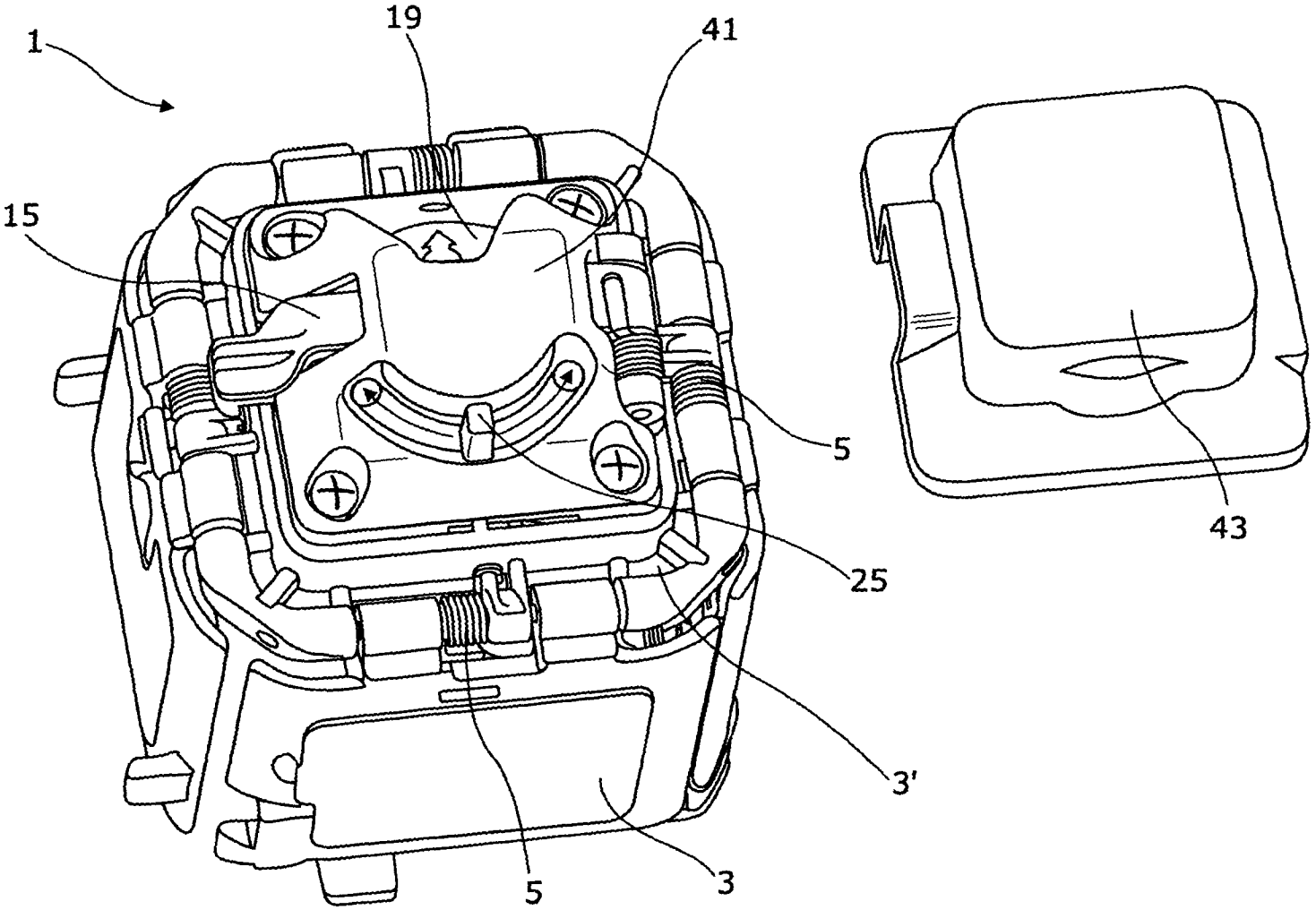
Figure 1F:
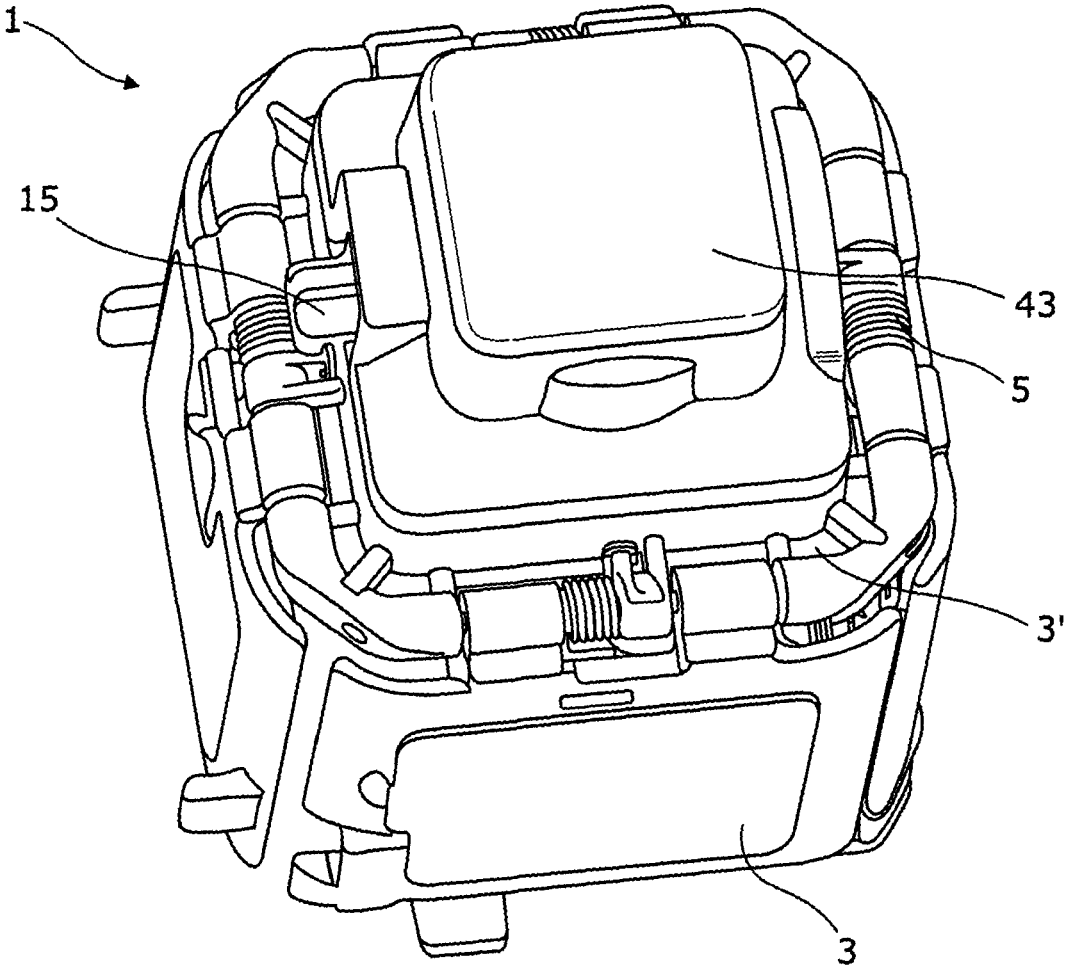

The formations 7 and selection mechanism 17 may be secured to the interior side of the panel 3' by the provision of a housing 35 which locates over the formations 7 and the pin 21, shown in position in FIG. 1*b*. An aperture 37 is provided in the centre of the housing 35 for the rotating disc 19 to be located and secured therein, shown in FIG. 1*c*. The catch 15 is then located across the disc 19 and housing 35, as in FIG. 1*d*. The catch 15 includes a curved portion 39, which is positioned about a central point of the disc 19, such that as the disc 19 is rotated and thus the pin member 21 moved, the aperture 27 of the disc 19 remains under the curved portion 39 and, consequently, whenever the pin 21 is raised, it will engage the catch 15 at some point along or around the curved portion 39. The gripping portion 25 of the disc 19 is located at a periphery of the disc 19 and can be moved back and forth along arrow A, thereby rotating the disc 19. A second housing 41 is subsequently placed over the catch 15 and disc 19 and secured to the corners of the first housing 37, thereby fixing the catch 15, mechanism 17 and formations 7 and first housing 37 all in place on the interior side of the panel 3', shown in FIG. 1*e*. Finally, as shown in FIG. 1*f*, a protective cover 43 is provided to fit over the mechanism 17 and outer housing 41. The cover 43 is removable in order that a user may access the mechanism 17, or at least the gripping portion 25 thereof, but serves to protect and disguise the mechanism from damage when the toy 1 is in the second, inverted position.

In a further embodiment of the present invention, and as shown in FIGS. 5*a-b*, there is provided a further article in the form of a training, or master cube 45. The master cube 45 is arranged to have five standard faces 47 and a sixth face 49, which includes a number of recesses 51 and formations 53 located thereon. In this example, three recesses 51 and three formations or protrusions 53 are provided, and are done so as to match the formations 7, 7' on the toy article 1. The recesses 51 are arranged to complement and receive the formations 7 which can be selected to be blocked from movement, and which would usually act as a trigger for another toy 1. The protrusions 53 are arranged to complement and engage the formations 7' which can be selected to be activated the release catch 15 of the toy 1. The protrusions 53 are provided to be substantially solid and rigid members and thus upon engagement with a toy 1, will ensure the predetermined condition is met for it, moving the toy 1 from the first position to the second position, regardless of the configuration in which it has been placed and which of the three formations 7' is actually selected to activate the release catch. A pair of magnets 55 may be provided on the face 49, as per the toy 1, and used to align the master cube 45 and toy 1 prior to the respective faces engaging.

The invention claimed is:

1. An article, said article being moveable between a first position and a second position and biased to the second position, said article being retained in the first position by retaining means until a predetermined condition is met, wherein when said predetermined condition is met a biasing means are released to move the article from the first position to the second position, said predetermined condition is met when at least one formation of a plurality of formations located with respect to at least one face of the article, is moved from a first position to a second position, thereby releasing said retaining means, the article further including user selection means to allow a user to select which one, or combination, of the plurality of formations, when moved, will cause the release of said retaining means, wherein said selection means further includes at least one blocking member, moveable in conjunction with a pin member of the selection means and by a selection portion of the selection means, and wherein upon selection of a first formation of the plurality of formations by the selection means to be movable to release said retaining means, a second formation of the plurality of formations is simultaneously selected, and the at least one blocking member is arranged to engage the second formation, preventing inward movement of the second formation with respect to the article.

2. An article according to claim 1, wherein the plurality of formations is provided on the article and all, a combination, or one, of said plurality of formations are selectable by the user via the user selection means to be that which, when moved, allows a change in condition to occur.

3. An article according to claim 1, wherein said selection means includes a selection portion being user-actuable to configure the selection means to determine which one, or combination, of the plurality of formations is to be movable to release the retaining means.

4. An article according to claim 3, wherein said selection portion is a rotatable member in the form of a rotatable disc or disc-shaped member and includes a user gripping portion.

5. An article according to claim 1, wherein said selection means further includes at least one pin member, arranged to provide mechanical communication between a selected formation and said retaining means.

6. An article according to claim 1, wherein said at least one blocking member is provided to substantially block inward movement of at least one formation.

7. An article according to claim 1, wherein said at least one blocking member may be provided as a rotatable member having one or more blocking portions located thereon.

8. An article according to claim 1, wherein said selection means is arranged to be movable to configure at least one formation to act as a trigger means to release said retaining means upon inward movement and configure at least one formation not to be movable.

9. An article according to claim 1, wherein at least three formations of the plurality of formations are provided: at least one formation being selectable to release said retaining means upon movement; at least one formation being selectable to be blocked from movement; and at least one formation provided to remain unselected by said selection means.

10. An article according to claim 1, wherein said formations are provided to interact with a plurality of formations provided on second and further articles.

11. An article according to claim 1, wherein said second position is an inverted form of the article with respect to said first position and said selection means is located in an interior of the article, when the article is in the first position.

12. An article according to claim 1, wherein the selection means further includes cover means thereon to protect the mechanism of the selection means when the article is moved to the second position.

13. An article according to claim 12, wherein said cover means is removable, thereby permitting a user to access said selection means and configure the article as desired.

* * * * *